United States Patent [19]

Alender et al.

[11] Patent Number: 4,648,282

[45] Date of Patent: Mar. 10, 1987

[54] POWER SCREWDRIVER

[75] Inventors: Wolfgang J. Alender; Heinz-Gerhard Anders; Hermann J. Leuthner, all of Aalen, Fed. Rep. of Germany

[73] Assignee: Cooper Industries, Houston, Tex.

[21] Appl. No.: 733,011

[22] Filed: May 10, 1985

[30] Foreign Application Priority Data

May 15, 1984 [DE] Fed. Rep. of Germany ... 8414766[U]

[51] Int. Cl.[4] ..... B25B 23/145

[52] U.S. Cl. ..... 73/862.23; 73/862.31; 73/862.35; 173/12

[58] Field of Search ..... 73/761, 773, 862.21, 73/862.23, 862.24, 862.31, 862.35, 862.49; 173/12; 81/467, 469, 477, 479

[56] References Cited

U.S. PATENT DOCUMENTS 3,596,718 8/1971 Fish et al. .
4,084,429 4/1978 Boland ..... 73/773 X
4,104,778 8/1978 Vliet ..... 73/761 X
4,162,639 7/1979 Gill .
4,544,039 10/1985 Crane ..... 73/862.35 X

FOREIGN PATENT DOCUMENTS 1581101 12/1980 United Kingdom .

*Primary Examiner*—Charles A. Ruehl
*Attorney, Agent, or Firm*—E. E. Scott; A. R. Thiele

[57] ABSTRACT

A power screwdriver or nutsetter has an output shaft provided with a torque measuring transducer and a shaft rotation angle transducer mounted thereon. Tool output torque or final turning of a screw or nut can be measured directly and transmitted to a control unit through a shaft mounted slipring assembly. In one embodiment a bevel gear drive is connected to the output shaft and a force measuring transducer is mounted between the shaft and the tool housing for measuring gear reaction forces corresponding to tool output torque.

11 Claims, 7 Drawing Figures

POWER SCREWDRIVER

BACKGROUND OF THE INVENTION

1. Field of the Invention

The invention relates to a power screwdriver having a torque or rotating angle sensing element associated with the output shaft.

2. Background

Power screwdrivers are known such as described in German Patent Specifications DE-AS 24 23 300 and DE-OS 31 27 753, which exhibit right-angle gear units as an output or downline spur gear units including transducers which serve to measure the torque and/or the rotation angle during driving. As soon as the required rotation angle and/or the required torque is obtained, the measuring/control electronics generates a signal, usually a cutoff signal, with the result that the driving operation is terminated.

In the known power screwdrivers, the transducers and the transmitter are provided in the area of the drive shaft. Consequently, for example, a torque which is applied to a screw can be measured only indirectly. This is because the right-angle gear unit of the spur gear unit is situated between the bit, which is in engagement with the screw, and the drive shaft. Such speed-transforming gear units and above all the occurring friction and the associated inefficiency of the gear unit adversely affect the measuring accuracy. In the case of safety-type screw connections, the screws are tightened to their yield point. However, when the yield point is reached, the power screwdriver must reliably switch off so that the screw is not inadmissibly strained. With the known power screwdrivers in which the transducers are disposed in the area of the drive or on the drive shaft, this requirement cannot be met.

The object of the invention is to provide a power screwdriver of the initially mentioned kind such that the transducers for the torque and/or rotation angle can be disposed without increasing the overall dimensions of the power screwdriver housing in such a way that the influence of the gear unit and the friction are eliminated during measuring.

SUMMARY OF THE INVENTION

The transducer and the transmitter of the power screwdriver according to the invention are disposed inside the housing of the power screwdriver in the area of the output shaft. The transducer is therefore situated in the area of the output part, with the result that the influence of the gear unit and of the friction occurring in the measurements during driving have no influence on the measuring accuracy. With a power screwdriver according to the invention, the parts which are to be screw-connected can be reliably tightened to the yield point without there being the danger of their being overstrained. As a result of the design according to the invention, the measured values are established directly by bypassing the speed-transforming gear unit and are tranmitted to the control electronics. The transmission element, which transmits the measured values from the transducer to the measuring/control electronics, is rotationally rigidly connected to the output shaft and rotates with the latter. Its slipring is contacted by the sensor with which the measured signals are relayed to the outside to the measuring/control electronics. The transmitter is situated in an easily accessible place inside the gear unit housing.

Further features of the invention will become apparent from the claims, the detailed description and the drawings.

The invention is explained in greater detail with reference to some embodiments shown in the drawings.

DESCRIPTION OF THE PREFERRED EMBODIMENTS

Figure 1:
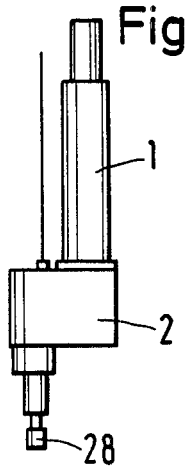
FIG. 1 shows in a diagrammatic representation a stationary power screwdriver according to the invention with flanged-on spur gear unit.
Figure 2:
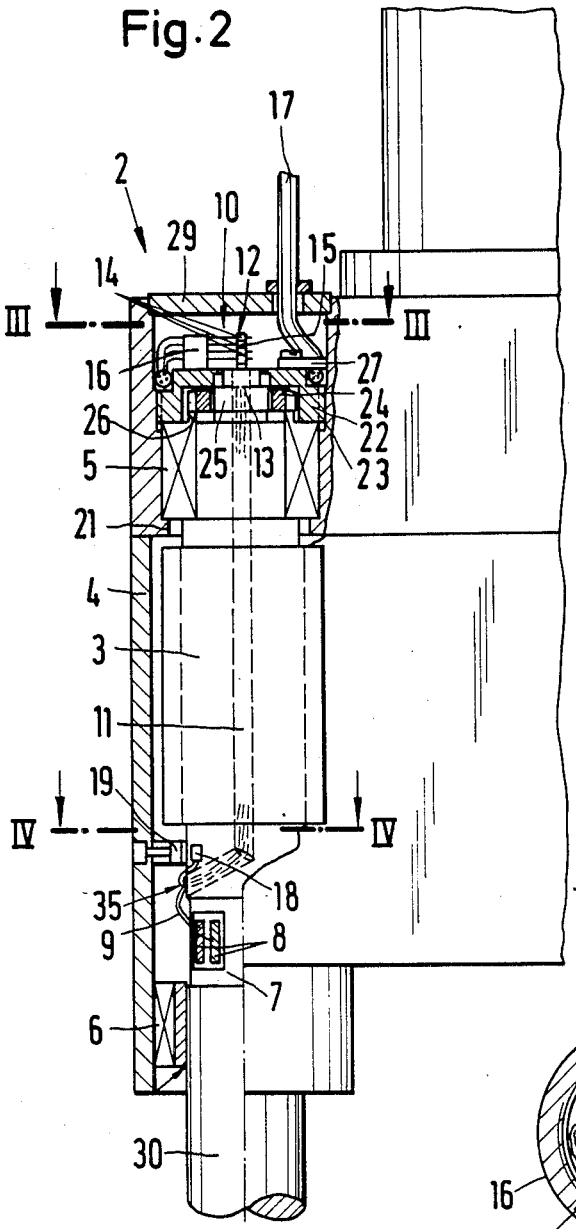
FIG. 2 shows in an enlarged representation and in a partial section the spur gear unit of the power screwdriver according to the invention in FIG. 1.
Figure 4:
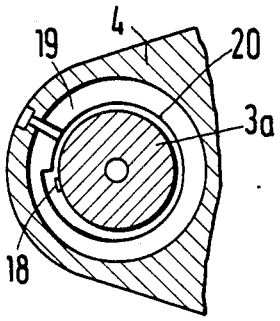
FIG. 4 shows a section taken on line IV—IV in FIG. 2.
Figure 3:
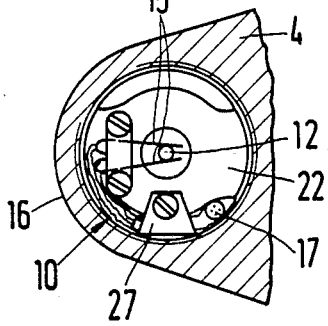
FIG. 3 shows a section taken on line III—III in FIG. 2.

The power screwdriver shown in FIGS. 1 to 4 has a straight motor part 1 with a motor and a planetary gear unit. Disposed in known manner on the motor part 1 is the housing of a spur gear unit 2 which has a drive pinion and an output gearwheel 3 which is seated on an output shaft 3*a*. The output shaft 3*a* is supported in the gear unit housing 4 by two spaced-apart bearings 5 and 6. In the area between the output gearwheel 3 and the bearing 6 the output shaft 3*a* is provided with a torsion part 7 which is formed by a reduced-diameter section of the output shaft. Strain gauges 8, acting as a transducer, are bonded on the torsion part 7 in known manner as a signal generator for the torque applied to a screw.

The signal generated by the strain gauges 8 when a torque is applied to a screw is supplied via connecting lines 9 to a transmitter 10. The connecting lines 9 extend through a bore 11 in the output shaft 3*a* to the transmitter 10. The bore 11 may be provided centrally or eccentrically in the output shaft 3*a*. The transmitter 10 is disposed at the upper end of the output shaft 3*a* and has a pin-shaped transmission element 12 which is rotationally rigid in the bore 11.

The connecting lines 9 are connected to soldering lugs 13 of the transmission element 12 which is provided at its end projecting beyond the output shaft 3*a* with a number of sliprings 14 corresponding to the number of connecting lines 9. The sliprings 14 are contacted by sensors 15 of a brushgear unit 16 from which the measured signals are relayed in a multi-core cable 17 to the outside to the measuring/control electronics (not shown).

During screwdriving, the torsion part 7 is subjected to torsion by the reactive force of the screw. The magnitude of the torsion is a measure of the torque applied and is converted by the strain gauges 8 into corresponding signals which are evaluated by the measuring/control electronics.

In similar manner to the torque signals, the revolutions of the output spindle are also monitored, for example, by a rotation angle pickup 18 which is disposed on the output shaft 3*a*. The rotation angle pickup 18, which may be, for example, a magneto-resistive sensor, is likewise bonded on the output shaft 3*a*. In the specimen embodiment, the rotation angle pickup 18 is situated in the area outside the torsion part 7. In the area of the rotation angle pickup 18 the output shaft 3*a* is surrounded by a disk-shaped magnet core 19 which is attached on the inside of the gear unit housing 4 and whose active zone 20 (FIG. 4) facing the rotation angle pickup 18 is in the form of a spiral. Consequently, as the output shaft 3*a* turns, the distance between the rotation angle pickup 18 and the active zone 20 changes. The output voltage of the rotation angle pickup 18 changes according to this distance, as a result of which the precise measurement of the instantaneously covered rotation angle is made possible. The electrical lines 35 bringing the rotation angle signal from the rotation angle pickup 18 are likewise routed through the bore 11 in the output shaft 3*a*.

The two bearings 5, 6 are provided for guiding and supporting the output shaft 3*a*. The bearing 5 is fixed in the axial direction. On its side facing the bearing 6, the bearing 5 is in contact with the inward-projecting shoulder 21 of the gear unit housing 4. On the other side, the bearing 5 is axially locked by a nut 22 which is screwed into a threaded hole 23 in the gear unit housing 4 and with which the bearing 5 is pressed against the shoulder 21. The nut 22 is in the form of a cap nut within which there is a further nut 24 which is screwed onto a threaded, axial stud 25 of the output shaft 3*a* and which is supported on the inner race 26 of the bearing 5. Consequently, the output shaft 3*a* is axially fixed. The brushgear unit 16 is mounted on the nut 22. For the cable 17 a strain relief device 27 is provided which is likewise releasably mounted on the nut 22. The cable 17 is brought out of the gear unit housing 4 to the outside in known manner.

In this embodiment, the strain gauges 8 and the rotation angle pickup 18 are disposed on the output shaft 3*a*. Since the appropriate bit 28 (FIG. 1) is attached to the output shaft 3*a*, the corresponding torques and rotation angles can be measured directly during screwdriving and can be transmitted to the control electronics. Between the bit 28 and the strain gauges 8 as well as the rotation angle pickup 18 there is no interposed gear unit which might adversely affect the measuring accuracy. The transmitter 10 is easily accessible since it is mounted on the end face of the output shaft 3*a* directly under a removable cover 29 of the gear unit housing 4.

Figure 5:
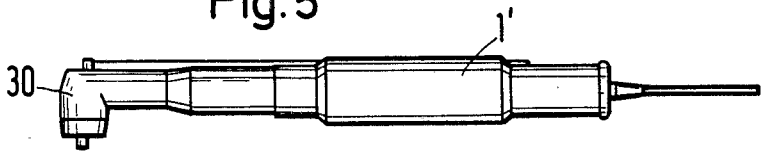
FIG. 5 shows in a diagrammatic representation a power screwdriver according to the invention with a right-angle gear unit.
Figure 6:
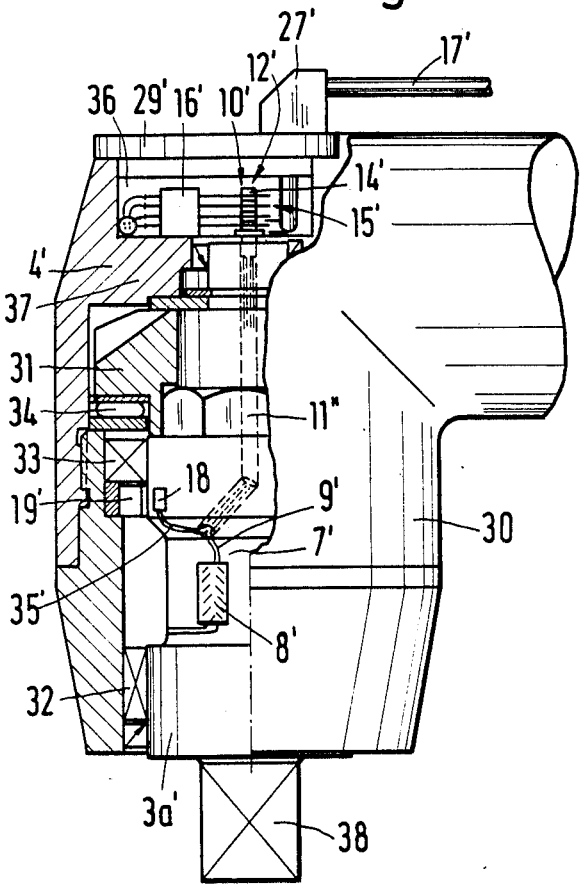
FIG. 6 shows in an enlarged representation and in a partial section the right-angle gear unit of the power screwdriver according to the invention in FIG. 5 with integrated torque transducer and rotation angle pickup.

FIG. 5 shows a further embodiment of a power screwdriver. A right-angle gear unit 30 is provided on the straight motor part 1' as a step-down gear unit. Provided as the right-angle gear unit is a bevel gear unit, of which one bevel gear 31 is shown in FIG. 6. The bevel gear 31 is likewise seated on the output shaft 3*a'* which is rotatably supported in the gear unit housing 4' by radial bearings 32 and 33 as well as by a thrust bearing 34. The thrust bearing 34 is situated in the area below the bevel gear 31 which is supported on the thrust bearing. The output shaft 3*a'* has the reduced-diameter torsion part 7' on which the strain gauges 8' are mounted. The connecting lines 9' are, as in the previous embodiment, routed through the bore 11' in the output shaft 3*a'* to the transmitter 10' which is of identical design to the transmitter used in the previously described embodiment. Provided directly adjacent to the radial bearing 33 on the side facing the torsion part 7' is the rotation angle pickup 18' which is surrounded by the magnet core 19' which is attached on the inside of the housing 4'. Lines 35', which relay the rotation angle signal from the rotation angle pickup 18', are routed through the bore 11'.

The transmitter 10' is accommodated in a recess 36 of the gear unit housing 4', said recess 36 being closable by the cover 29'. The brushgear unit 16' is seated on an inward-projecting shoulder 37 of the housing 4'. The transmission element 12' with the sliprings 14' as well as the sensors 15' are of identical design to those in the previously described embodiment. The strain relief device 27' is attached on the cover 29'. The transmission element 12', which is mounted in the bore 11', rotates together with the output shaft 3*a'* and the bevel gear 31 while the brushgear unit 16' with the cable 17' is stationary. The bearings 32 to 34 are axially locked inside the housing 4'. At its end facing away from the transmitter 10', the output shaft 3*a'* is provided with a connecting part 38 for the respective bit.

In this embodiment, which shows a predominantly hand-held power screwdriver, the measurements of the torque and of the rotation angle can once again be performed without impairment by the right-angle gear unit, with the result that the parts which are to be screw-connected can be brought reliably, for example, to the yield point.

Figure 7:
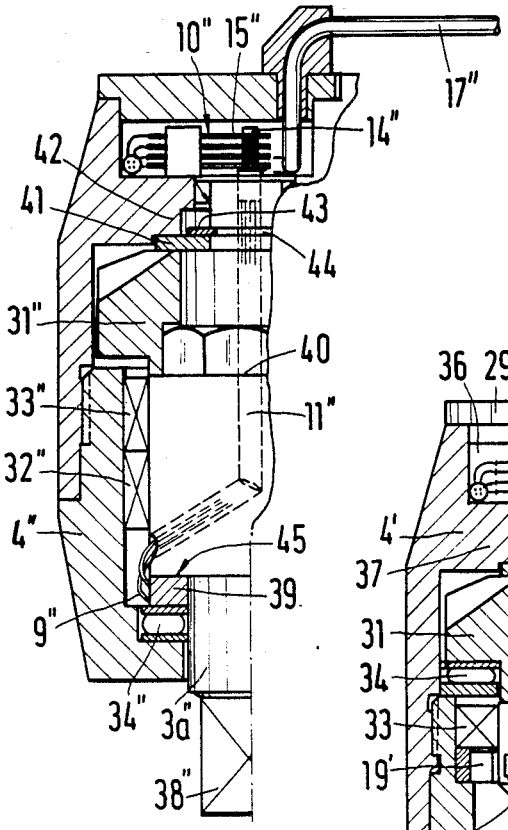
FIG. 7 shows in a partial section a further embodiment of a right-angle gear unit with a pressure transducer for indirect torque measurement.

FIG. 7 shows an embodiment of a power screwdriver in which the torque is measured by a force transducer 39 whose measured signals are relayed via the connecting lines 9'' in the described manner through the bore 11'' in the output shaft 3*a''*. In this embodiment, the torque at the output is measured indirectly. This embodiment is similar in design in some respects to the embodiments shown in FIGS. 5 and 6. The step-down gear unit is once again a bevel gear unit, of which merely the bevel gear 31'' is shown. The output shaft 3*a''* is rotatably supported inside the gear unit housing 4'' by two abutting radial bearings 32'', 33'' and a thrust bearing 34'' near the connecting piece 38''. The bevel gear 31'' is seated on a shoulder 40 of the output shaft 3*a''* and is axially locked by a retaining ring 41 which is situated between the bevel gear and a further shoulder 42 on the inside of the gear unit housing 4''. Furthermore, the retaining ring 41 is locked by a spring lock washer 43 which engages an annular groove 44 in the output shaft 3*a''*. The transmitter 10'' is of identical design to the one used in the embodiment in FIG. 6.

The transmission of torque to the output bevel gear 31'' results in axial force components of the peripheral force. These force components are in a certain ratio to the transmitted torque and can, therefore, also be used to measure the torque. The axial force component of the bevel gear 31'' is transmitted via the shoulder 40 to the output shaft 3*a''*. The latter, in turn, is supported via a further shoulder 45 on the force transducer 39 which, in turn, rests on the thrust bearing 34''. The magnitude of the axial force component and thus the transmitted torque are measured by the force transducer and are relayed through the connecting lines 9'' to the transmitter 10'', from where the signals are supplied via the cable 17'' to the measuring/control electronics.

The transducers 39 which is in the form of a force transducer is of annular design and is seated on the output shaft 3*a*″.

In the embodiments in FIGS. 1 to 6, the torque is measured by means of strain gauges acting as transducers. Instead of such strain gauges, it is also possible to employ piezo measuring elements. Also possible are inductive transducers or permeability measurements which are performed at the torsion-exposed outer cylindrical surface of the output shaft.

In all embodiments, the sliprings 14, 14′, 14″ are provided at their points of contact with the sensors 15, 15′, 15″ with grooves, fillets or similar configurations in order to guarantee undisturbed transmission of the measured values also in the case of axial impacts or slight shifts of the output shaft 3*a*, 3*a*′, 3*a*″.

What we claim is:

1. A power screwdriver with a drive motor whose drive shaft has a drive connection via a gear unit to an output shaft with which a bit can be driven, and with at least one transducer accommodated in a housing and serving to measure parameters during driving, such as torque and/or the rotation angle of the output shaft, wherein the transducer is rotationally rigidly connected to the output shaft and further includes means for transmitting electrical signals from said transducers to at least one slip ring and stationary sensor, said stationary sensor being part of a brush gear unit which is rotationally rigidly disposed in the housing by being situated on a covering nut which covers a free end of the output shaft and which is screwed into a threaded hole of said housing so that parameters such as torque and/or the rotation angle of the output shaft may be transmitted to a control mechanism.

2. A power screwdriver as defined in claim 1, wherein:

said means for transmitting electrical signals from said transducer is situated in an axial bore of the output shaft.

3. A power screwdriver as defined in claim 1, wherein:

the transducer is bonded to the output shaft.

4. A power screwdriver as defined in claim 1, wherein:

the output shaft is rotatably supported in the housing by at least two bearings of which one bearing is clamped between an inside shoulder of the housing and the covering nut.

5. A power screwdriver as defined in claim 4, wherein:

a second nut is screwed onto the free end of the output shaft and is supported on the inner race of one of the bearings.

6. A power screwdriver as defined in claim 5, wherein:

the second nut is covered by the covering nut.

7. A power screwdriver as defined in claim 1, wherein:

the gear unit is a bevel gear unit and the transducer is a force transducer on which the output shaft is supported by a shoulder.

8. A power screwdriver as defined in claim 7, wherein:

the transducer is supported on a thrust bearing.

9. A power screwdriver and the like comprising a housing, a drive motor drivingly connected to an outut shaft through bevel gear drive means including a bevel gear drivingly connected to said output shaft, means for determining the torque output of said output shaft during operation of said screwdriver including a force measuring transducer interposed between said output shaft and said housing for measuring a reaction thrust force exerted on said output shaft by said bevel gear and corresponding to torque exerted on said output shaft by said motor, and signal transmission means including a slipring for transmitting a signal from said transducer through said output shaft to the exterior of said housing.

10. The screwdriver set forth in claim 9, wherein:

said output shaft is supported by a thrust bearing and said force transducer is interposed between said thrust bearing and a shoulder formed on said output shaft.

11. A power screwdriver and the like comprising a housing, a drive motor drivingly connected to an output shaft through gear drive means, bearing means for supporting said output shaft in said housing, means for determining the torque output of said output shaft during operation of said screwdriver including a transducer disposed on said output shaft for measuring a torque exerted on by said motor, connecting lines connected to said transducer and to a slipring assembly mounted on one end of said output shaft and within said housing, said connecting lines extending through a bore in said output shaft to said slipring assembly, and means for sensing the rotation angle of said output shaft relative to said housing including an angle sensor element on said output shaft including further connecting lines leading from said element to said slipring assembly through said bore.

* * * * *